United States Patent [19]

Sheets

[11] 4,429,832

[45] Feb. 7, 1984

[54] PROJECTABLE LAWN SPRINKLER

[76] Inventor: Kerney T. Sheets, P.O. Box 771, Duplessis, La. 70728

[21] Appl. No.: 312,351

[22] Filed: Oct. 16, 1981

[51] Int. Cl.[3] ..... B05B 15/10

[52] U.S. Cl. ..... 239/204; 239/288.5

[58] Field of Search ..... 239/203, 204, 205, 206, 239/288.5

[56] References Cited

U.S. PATENT DOCUMENTS 3,709,435 1/1973 Sheets ..... 239/204 X 4,145,003 3/1979 Harrison et al. ..... 239/204 X

*Primary Examiner*—John J. Love

*Assistant Examiner*—Mary F. McCarthy

*Attorney, Agent, or Firm*—David L. Ray

[57] ABSTRACT

A projectable guard for a projectable lawn sprinkler for preventing foreign matter from entering the sprinker. The sprinklers to which the projectable guard is attached automatically rise from the ground when water pressure is applied thereto. The sprinklers have a housing, a pipe rigidly connected to the housing, a projectable conduit connected to the pipe, and a sprinkler head attached to the projectable conduit. The boot connects to the housing and the projectable pipe to prevent grass, leaves, sand, dirt, and the like from entering the housing.

3 Claims, 3 Drawing Figures

PROJECTABLE LAWN SPRINKLER

BACKGROUND OF THE INVENTION

The present invention relates to sunken lawn sprinklers which are automatically projected or advanced to a position above the surrounding ground level when water pressure is applied to the sprinkler. In particular, the invention relates to a projectable guard which may be connected to such sprinklers to prevent foreign particles such as grass, leaves, sand, dirt, and the like from entering the portion of the housing beneath the boot.

Many parks and schools, athletic fields, golf courses, and residences are installing automatic irrigation systems to provide adequate moisture for landscaping and to maintain vast acres of lawn in a high degree of perfection. In such applications the pop-up type of sprinkler heads have been found most desirable to facilitate ground maintenance. Further, by using popup sprinkler heads which retract out of sight when not in use, the hazards associated with permanently elevated obstruction are eliminated. Such hazards include accidents incurred by tripping or falling over the sprinkler, striking the sprinkler with a lawnmower or automobile, and theft of a permanently elevated sprinkler head.

Many forms of projectable sprinklers have been proposed both commercially and in the patent literature. U.S. Pat. Nos. 4,010,901; 3,758,038; 3,104,822; 2,611,644; and 2,013,849 disclose various types of pressure operated pop-up sprinklers. By the term "pressure operated" is meant that the lawn sprinklers are projected up by the pressure of the water supplied to the sprinklers. Another method of raising or projecting a sprinkler is disclosed in U.S. Pat. Nos. 3,921,911 and 3,709,435 wherein the projectable lawn sprinklers float upward from the ground.

One difficulty encountered in making a sucessful pressure operated lawn sprinkler has been the complexity and number of parts required. Some sprinklers are costly to manufacture, difficult to assemble, repair and service, and are unreliable in operation. Furthermore, pressure operated pop-up sprinklers have suffered from the inability to seal well. Poor sealing causes an unnecessary large drop in pressure with the result that fewer projectable sprinklers than permanently raised sprinklers could be used on a supply line of given hydraulic capacity.

A further problem encountered in prior art projectable lawn sprinklers was that to prevent the stand pipe projected from the ground from rocking, it was necessary to have the relatively movable parts fit one another quite closely and to have lengthy bearing surfaces, i.e., lands. However, when the parts fit closely, natural friction develops and foreign matter tends to stick between the parts. This sometimes jams the stand pipe, and at other times scores the parts so as to permit leakage to develop. Furthermore, the use of long lands requires additional force to raise the stand pipe, and it is therefore more vulnerable to jamming.

From the above it can be seen that there is a need for a device and/or method for preventing sand, grass, leaves, dirt, and other foreign matter from entering the housing and jamming the moving parts.

SUMMARY OF THE INVENTION

A projectable guard for a projectable lawn sprinkler for preventing foreign matter from entering the sprinkler. The sprinklers to which the projectable guard is attached automatically rise from the ground when water pressure is applied thereto. The sprinklers have a housing, a pipe rigidly connected to the housing, a projectable conduit connected to the pipe, and a sprinkler head attached to the projectable conduit. The projectable guard connects to the projectable pipe to prevent grass, leaves, sand, dirt, and the like from entering the housing.

BRIEF DESCRIPTION OF THE DRAWINGS

The invention will be more completely understood by referring to the drawings in which.

DESCRIPTION OF THE PREFERRED EMBODIMENT

Figure 1:
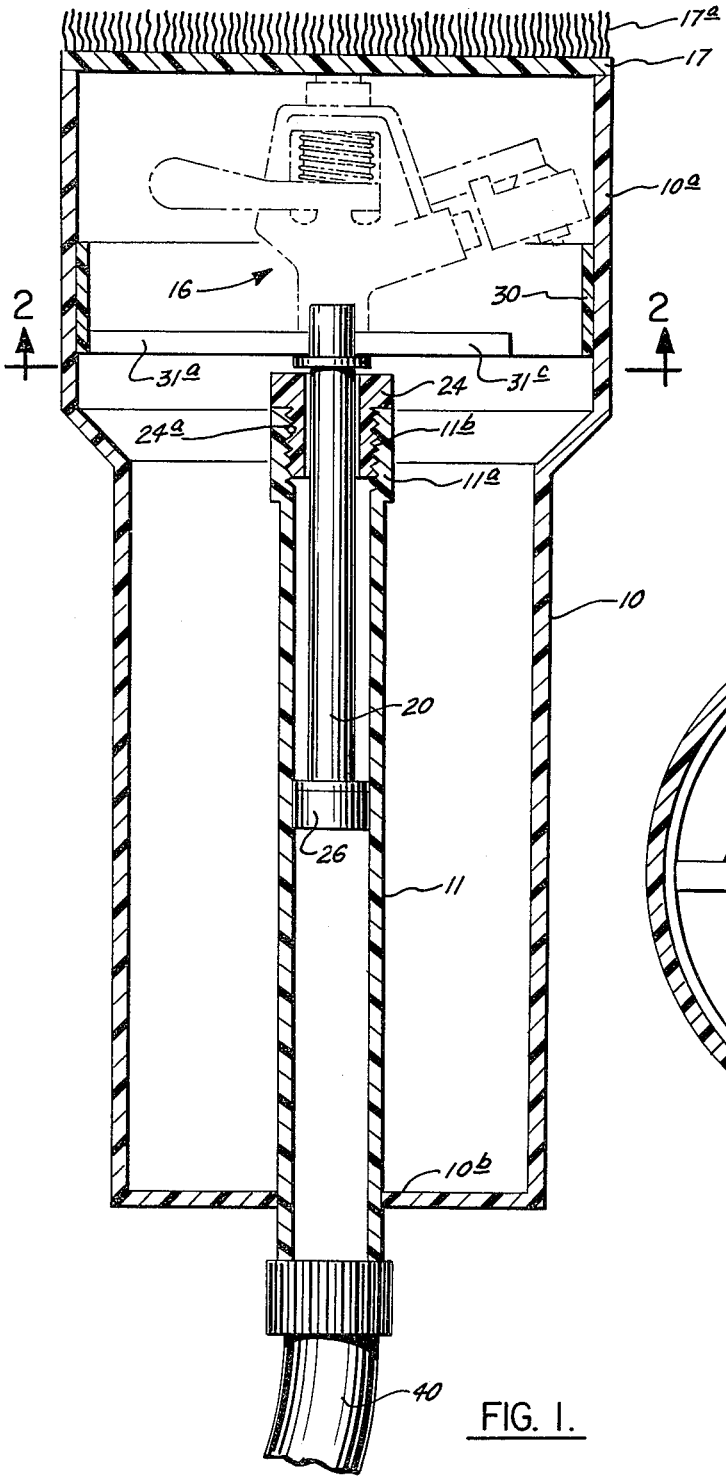
FIG. 1 is a cross-sectional view of the projectable lawn sprinkler in the retracted position.

Referring now to the drawings, the sprinkler can be seen to include a housing 10 having a generally cylindrical bore and an enlarged upper portion 10*a* and base 10*b*. It is not essential that housing 10 include an enlarged portion 10*a* since the diameter of housing 10 could be chosen to enclose the sprinkler head 16, but the construction shown in the drawings is preferred. Preferably, housing 10 has a hole or series of holes (not shown) in the bottom or sides thereof for permitting water which may collect in the housing to drain out.

Rigidly connected to base 10*b* is a generally cylindrical pipe 11 having a generally cylindrical enlarged portion 11*a* at the upper end thereof. As can be best seen in FIG. 1, the enlarged portion 11*a* has threads 11*b* therein. The bottom of pipe 11 has a hose 40 connected thereto for supplying water to the sprinkler. A pipe may be substituted for hose 40.

Figure 2:
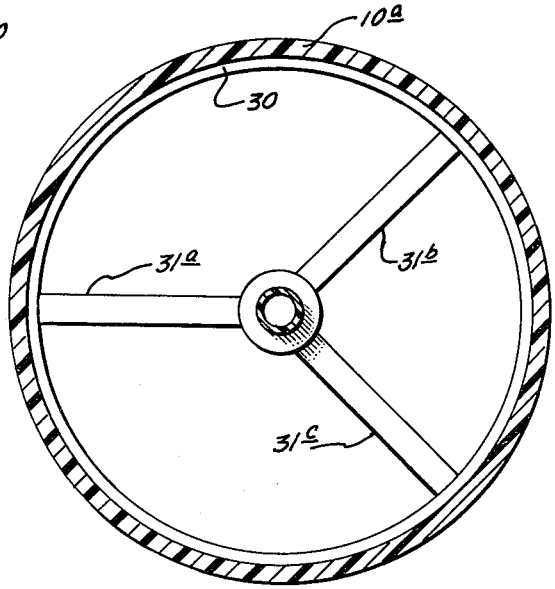
FIG. 2 is a cross-sectional view taken along with the lines 2—2 of FIG. 1.
Figure 3:
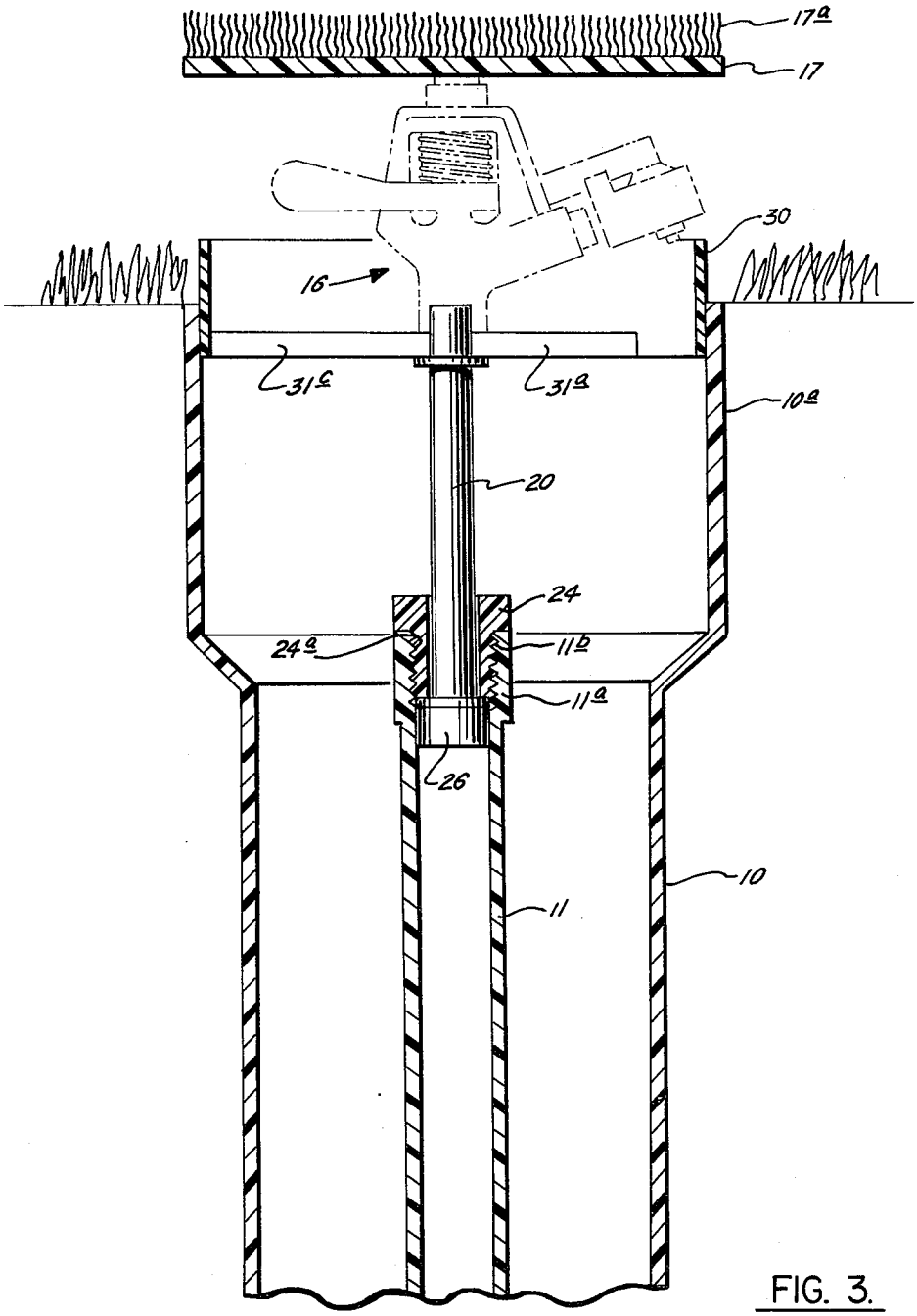
FIG. 3 is a partially cut-away, cross-sectional view of the projectable sprinkler in the projected position.

As can be seen in FIGS. 1 and 2, projectable conduit 20 is adapted for positioning inside pipe 11. Projectable conduit 20 is hollow inside and has an enlarged portion 26 at the lower end thereof which is slidably received in pipe 11. The enlarged portion 26 is of sufficient diameter to be snuggly received inside of pipe 11 while still being capable of sliding upward within pipe 11. Located immediately above the enlarged portion 26 is a washer 27 preferably made from a resilient material such as rubber, soft plastic, or the like, which aids in forming a water-tight seal to prevent water from pipe 11 from entering the interior of casing 10 when projectable conduit 20 is in the projected or upward position such as is illustrated in FIG. 3. Slidably received about projectable conduit 20 is a fitting 24 having threads 24*a* thereon which are received in threads 11*b* of stationary pipe 11. Fitting 24 limits the upward movement of projectable conduit 24.

At the upper end of projectable conduit 20 is attached sprinkler head 16. Sprinkler head 16 may be attached to conduit 20 in any conventional manner such as by threads or the like.

As can be seen in the drawings a cylindrical guard 30 is attached to projectable conduit 20 by a plurality of spokes 31*a*, 31*b* and 31*c*. Any desired number of spokes may be utilized. Preferably the spokes and guard are molded as one integral unit and then connected to projectable conduit 20 by gluing, welding, or the like.

Cylindrical guard 30 is slidably received inside of housing 10. When the sprinkler is projected upwardly as shown in FIG. 3, a portion of guard 30 extends upwardly above the upper edge of the upper portion 10*a* of housing 10 to prevent any leaves, sand, dirt or other trash from flowing into the interior of housing 10 as the ground around the sprinkler becomes saturated with water.

A lid 17 is rigidly attached to the top of sprinkler head 16 by any conventional means. Preferably the lid has a synthetic grass-like material 17*a* attached to the top thereof.

Sprinkler head 16 may be any conventional sprinkler head well-known in the art. Typical of the preferred sprinkler heads are the impact or impulse type similar to that disclosed in U.S. Pat. No. 3,309,025 issued Mar. 14, 1967 to Malcolm which is hereby incorporated by reference.

The operation of the sprinkler will now be described. When water is supplied under pressure to stationary pipe 11 such as by hose 40 shown in FIG. 1, water flows upward in stationary pipe 11 as is indicated by the arrow in FIG. 3, through projectable conduit 20, and outward through sprinkler head 16. The pressure of the water within stationary pipe 11 forces projectable conduit 20 upward into the projected position shown in FIG. 3 and guard 30 prevents trash from being washed into the interior of housing 10 by water sprinkled onto the ground around the outside of the housing.

The various components of the sprinkler of the present invention are preferably made from any suitable plastic material. However, other materials such as metals may be used. Plastics are preferred because of lower weight, lower cost and their resistance to corrosion. The various components of the sprinkler may be molded as one piece when such is feasible. For example, the casing 10 and pipe 11 could be molded as one piece as could guard 30 and projectable conduit 20.

If desired, the cylindrical housing 10 could be made of an elliptical or oval cross-sectional, or an irregular cross-section. Furthermore, projectable cover 30 and enlarged portion 11*a* of pipe 11 could be made of a similar oval or elliptical, or irregular section if desired.

Having described the invention it is desired that it be limited only within the spirit and scope of the following claims.

What is claimed is:

1. In a projectable lawn sprinkler having a housing, a stationary pipe located in the interior of said housing and connected to the base of said housing, a projectable conduit slidably connected to the interior of said stationary pipe, and a means for spraying water connected to said projectable conduit means, the improvement comprising guard means connected to said projectable conduit and slidably received inside said housing for preventing foreign matter from entering the interior of said housing, the top of said guard means being projectable to a position above the top of said housing, said projectable guard means being a cylinder, the top of said cylinder extending above the top of said housing when said projectable conduit means is projected to its uppermost height.

2. The guard means of claim 1 wherein said cylinder is connected to said projectable conduit by a plurality of spokes.

3. The guard means of claim 1 wherein said means for spraying water is a sprinkler head.

* * * * *